US005381901A

United States Patent [19]

Hundley

[11] Patent Number: 5,381,901

[45] Date of Patent: Jan. 17, 1995

[54] DUAL COMPARTMENT FOOD TRAY

[76] Inventor: Bobby V. Hundley, 9520 Stacy La., Union, Ill. 60180

[21] Appl. No.: 191,067

[22] Filed: Feb. 3, 1994

Related U.S. Application Data

[63] Continuation of Ser. No. 996,161, Dec. 23, 1992.

[51] Int. Cl.[6] ..... B65D 1/24; B65D 1/36

[52] U.S. Cl. ..... 206/457; 206/459.5; 206/518; 206/564; 220/675; 229/407

[58] Field of Search ..... 206/515, 518, 519, 520, 206/557, 561, 564, 457, 459.5; 229/2.5 R; 220/669, 675

[56] References Cited

U.S. PATENT DOCUMENTS

| | | | |
|---|---|---|---|
| 3,653,581 | 4/1972 | Ptal | 220/675 X |
| 4,026,457 | 5/1977 | Schubert | 229/2.5 R |
| 4,294,371 | 10/1981 | Davis | 229/2.5 R X |
| 4,381,847 | 5/1983 | Bessett et al. | 229/2.5 R |
| 4,899,881 | 2/1990 | Girard et al. | 206/557 X |

*Primary Examiner*—Jacob K. Ackun, Jr.
*Attorney, Agent, or Firm*—Emrich & Dithmar

[57] ABSTRACT

A nestable food or snack tray having a pair of recessed food storage compartments each adapted to receive and hold food is vacuum molded from a single sheet of lightweight plastic, such as polystyrene. A first recessed compartment is shaped in the form of an athletic field or stadium such as a tennis or basketball court, a baseball or football stadium, a hockey rink, etc., and includes a tiered, or step-like layered, peripheral portion representing court-side (or field-side) seats. The floor of the first recessed compartment includes various details of the court, field or rink and may include terrain features such as where the recessed compartment depicts a golf course. The tiered structure forms spaced horizontal ribs which increase the strength and rigidity of the lightweight plastic tray, particularly when the compartments carry food. A second recessed compartment is spaced from the first, stylized recessed compartment, with the respective bottoms of the compartments defining a plane for stable positioning of the tray on a flat support surface. The two compartments are separated by a gap into which the fingers of a user may be inserted for holding and supporting the tray in a balanced manner. The tray includes a flat upper surface disposed at least partially intermediate the two recessed compartments which is adapted for supporting a utensil such as a fork or a condiment such as a packet of salt and may carry a message or a symbol such as a trade or service mark.

3 Claims, 5 Drawing Sheets

DUAL COMPARTMENT FOOD TRAY

This is a continuation of co-pending application Ser. No. 07/996,161 filed Dec. 23, 1992.

FIELD OF THE INVENTION

This invention relates generally to trays for supporting food and is particularly directed to a dual compartment food tray wherein one of the recessed compartments is in the form of an athletic field and surroundings.

BACKGROUND OF THE INVENTION

Trays for supporting food during a meal are commonly used in various environments such as cafeterias and fast food service restaurants. A typical food tray includes a plurality of recessed compartments, each adapted for holding an individual food portion in a confined manner. Food trays vary in usage from the reusable type comprised of a sturdy, high strength plastic or even metal to the throw-away type which may be comprised of an inexpensive material such as styrofoam. While preferably lightweight, the disposable tray must also be of sufficient strength to withstand the forces encountered during use. In addition, the disposable tray should be of low cost and nestable with other similar trays to facilitate shipping, storing and handling of the trays. Finally, while the food tray serves a utilitarian function, it should also include a consumer-oriented feature such as a stylized, attractive shape and configuration and should be capable of accommodating a commercial message such as an advertisement.

The present invention provides the aforementioned desirable features in a dual compartment food tray comprised of a thin, lightweight plastic having a relatively high strength construction and an athletic field structure adapted for supporting and holding a portion of food.

OBJECTS AND SUMMARY OF THE INVENTION

Accordingly, it is an object of the present invention to provide a dual compartment food tray with a sports environment configuration which is lightweight and of relatively high strength.

It is another object of the present invention to provide a nestable plastic food tray which is easily supported in a stable manner either in a user's hand or on a flat support surface.

These objects of the present invention are achieved and the disadvantages of the prior art are eliminated by a food tray of unitary construction having top and bottom portions and including a first recessed compartment for receiving a first portion of food and having a first continuous tiered side wall in the general shape and form of an athletic facility and a first generally flat lower panel in the general shape and form of an athletic playing area forming a first portion of the bottom of the tray. The first recessed compartment is tapered inwardly in proceeding from top to bottom to simulate a baseball or football stadium or a tennis, hockey or basketball arena. The food tray further includes a second recessed compartment in spaced relation from the first recessed compartment for receiving a second portion of food, the second recessed compartment including a second continuous side wall and a second lower panel forming a second portion of the bottom of the tray, wherein the first and second lower panels are aligned and in a common plane. The food tray further includes a generally flat upper panel forming a portion of the top of the tray and disposed generally intermediate and formed integrally with the first and second recessed compartments for supporting an article such as a condiment or an eating utensil. The food tray is adapted for positioning on another similarly configured food tray in a nested manner, with the first and second recessed compartments of the tray positioned respectively in the first and second recessed compartments of another such food tray for storage. The tiered sidewall of the first recessed compartment increases the strength of the structure allowing a thin layer of plastic to be used in the food tray and contributes to an athletic environment appearance.

BRIEF DESCRIPTION OF THE DRAWING

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENTS

Figure 1:
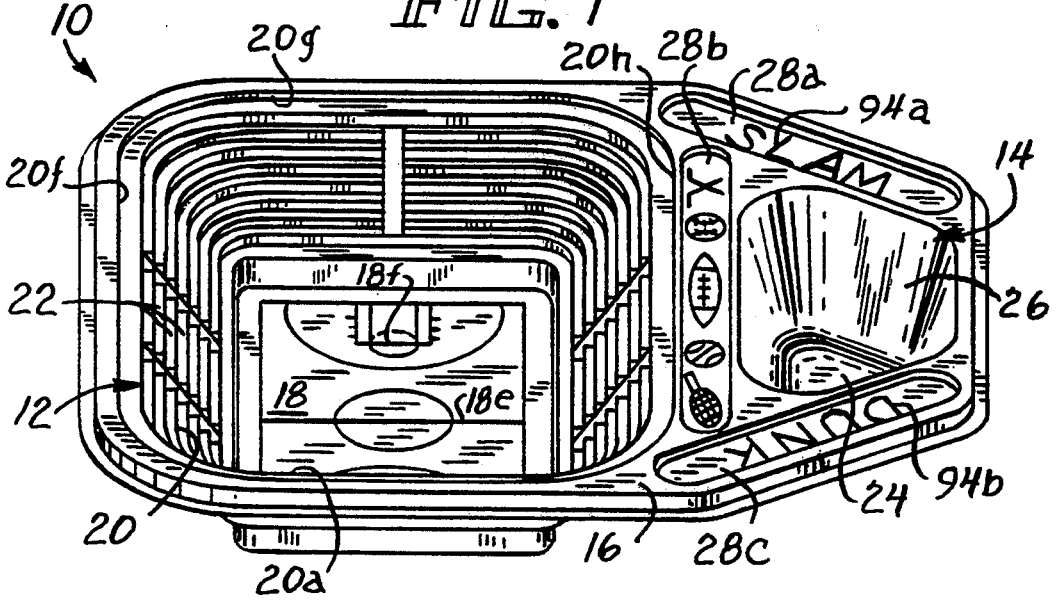
FIG. 1 is an upper perspective view of a dual compartment food tray, wherein one of the recessed compartments is in the form of a basketball arena in accordance with one embodiment of the present invention.
Figure 2:
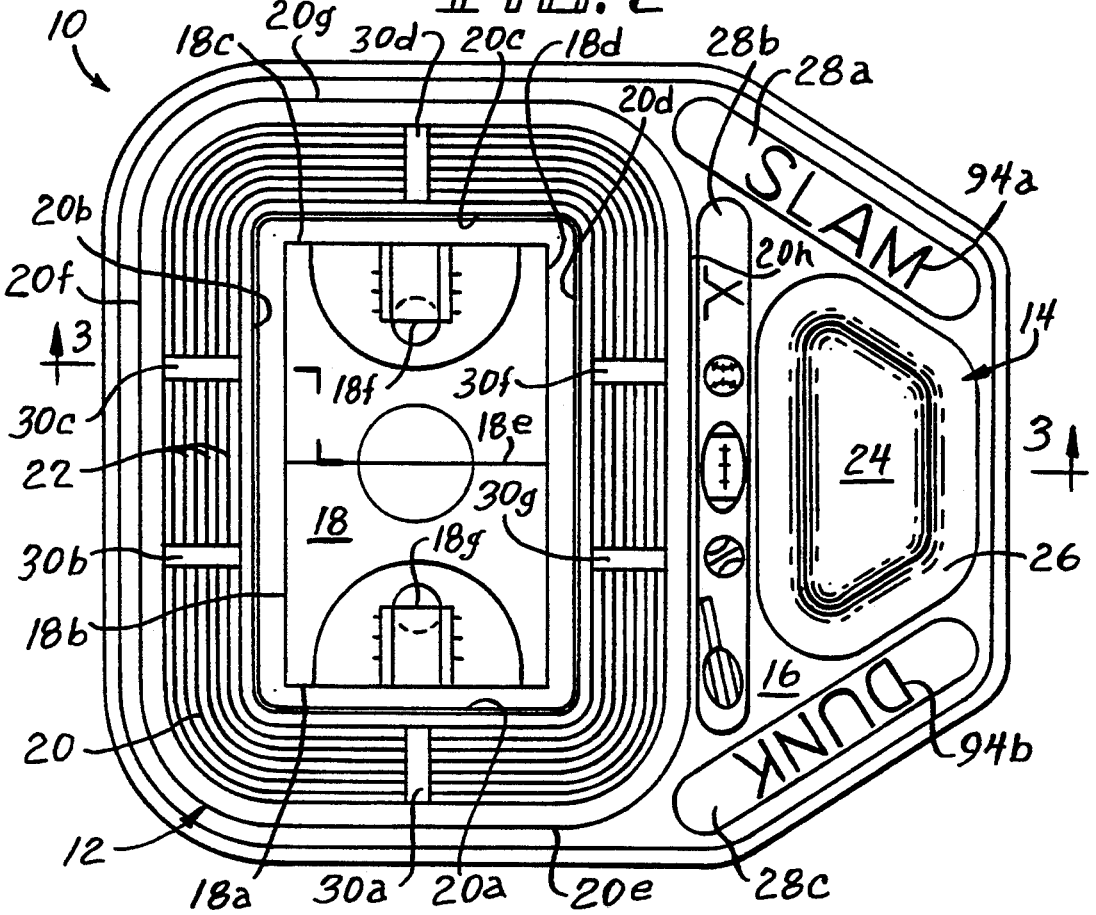
FIG. 2 is a top plan view of the dual compartment food tray of FIG. 1.
Figure 3:
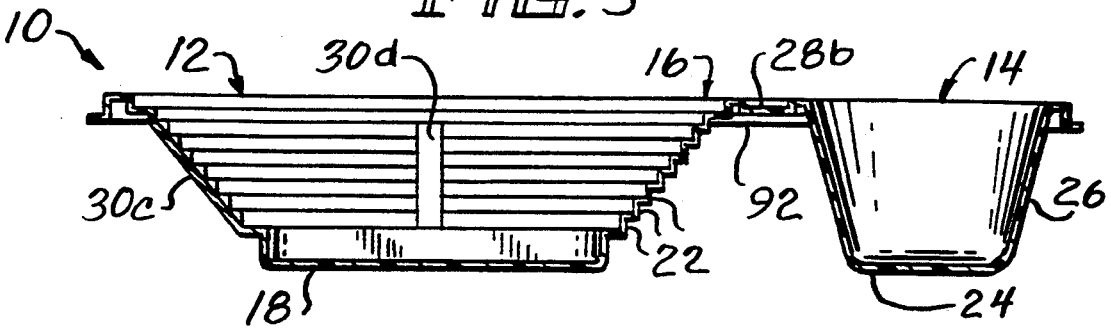
FIG. 3 is a sectional view of the dual compartment food tray of FIG. 2 taken along site line 3—3 therein.
Figure 4:
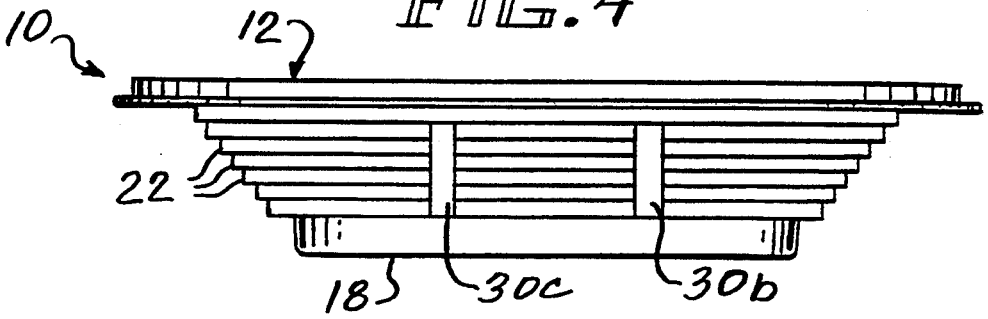
FIG. 4 is an end-on view of the dual compartment food tray shown in FIG. 2.

Referring to FIG. 1, there is shown an upper perspective view of a food tray 10 in accordance with one embodiment of the present invention. A top plan view and an end-on elevation view of the food tray 10 shown in FIG. 1 are respectively shown in FIGS. 2 and 4. A sectional view of the food tray 10 shown in FIG. 2 taken along site line 3—3 therein is illustrated in FIG. 3.

Food tray 10 includes first and second recessed compartments 12 and 14. A generally flat upper panel 16 is formed integrally with the first and second recessed compartments 12, 14 and forms a top portion of the food tray 10. A portion of upper panel 16 is disposed intermediate the first and second recessed compartments 12, 14. Upper panel 16 is adapted to receive and support an eating utensil or a condiment such as salt or catsup container (not shown in the figure for simplicity) while the food tray 10 is being used for eating. Upper panel 16 may be provided with one or more upper recesses 28*a* 28*b* and 28*c*, each of which is adapted to receive, support and retain an eating utensil or condiment. In addition, upper panel 16 may be provided with a commercial message or a sports-oriented saying or symbols 94*a* and 94*b*. As shown in FIGS. 1 and 2, the words "SLAM DUNK" are disposed in upper recesses 28*a* and 28*c*, while upper recess 28*b* contains various athletic symbols.

The first recessed compartment 12 includes a continuous side wall 20 having a step-like construction which is tapered inwardly in proceeding from top to bottom. Side wall 20 includes a plurality of step-like tiers 22 simulating a spectator seating arrangement such as in an athletic arena. To this end, tiered side wall 20 further includes a plurality of spaced aisles 30*a*–30*g* disposed in a spaced manner about the seating arrangement. Forming the bottom of the first recessed compartment 12 is a generally flat lower panel 18, which in this embodiment of the present invention is in the form and shape of a basketball court. The combination of the basketball court-styled lower panel 18 and tiered side wall 20 in the form of a spectator seating arrangement simulates a basketball arena and provides the food tray 10 with an athletic-oriented construction. The tiers 22 in side wall 20 increase the strength and rigidity of the food tray 10 and permit the food tray to be formed from a thin layer of semi-rigid plastic.

As shown in FIG. 2, the lower panel 18 includes four straight connected lines 18*a*–18*d* forming a closed rectangle defining sidelines of the basketball court, a fifth straight line 18*e* dividing the rectangle into two equal sections and forming a half court line, and sixth and seventh straight lines 18*f* and 18*g* disposed in a spaced manner and forming first and second free throw lines. Side wall 20 includes a first plurality of connected inner lower lines 20*a*–20*d* and a second plurality of connected outer upper lines 20*e*–20*h* respectively forming inner and outer peripheries of the spectator seating area.

The second recessed compartment 14 is disposed in a spaced manner from the first recessed compartment 12, with upper panel 16 separating the two compartments. The second recessed compartment 14 also includes a side wall 26 and a generally flat lower panel 24. As shown in FIG. 3, the first and second lower panels 18, 24 forming the respective bottom portions of the first and second recessed compartments 12, 14 are aligned in a common plane for stable positioning of the food tray 10 on a flat support surface. A slot 92 on a bottom portion of the food tray 10 is sized to receive a user's fingers for stabilizing and supporting the food tray.

Figure 5:
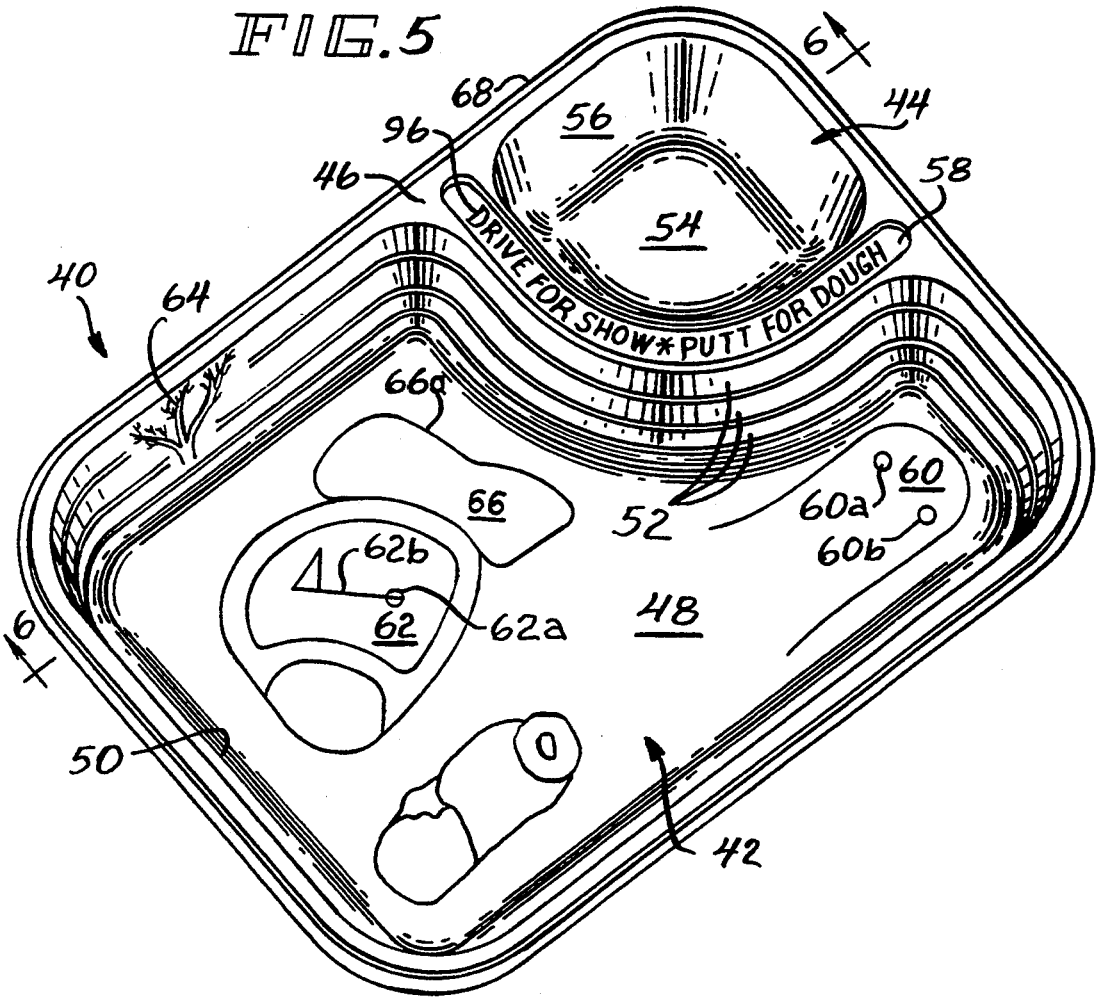
FIG. 5 is an upper perspective view of another embodiment of a dual compartment food tray in accordance with the present invention, wherein one of the recessed compartments is in the form of a portion of a golf course.
Figure 6:
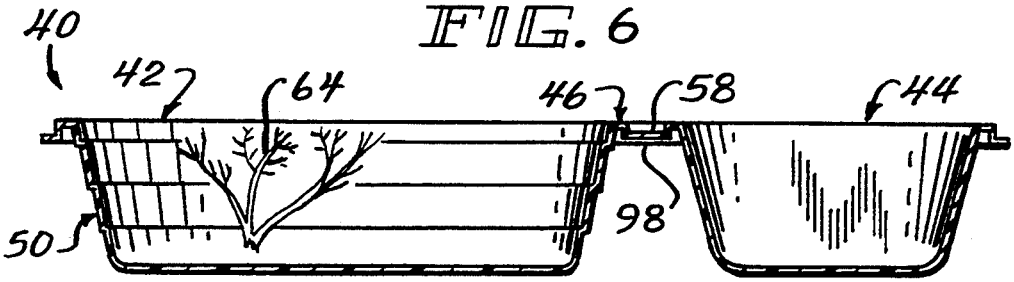
FIG. 6 is a sectional view of the dual compartment food tray of FIG. 5 taken along site line 6—6 therein.
Figure 7:
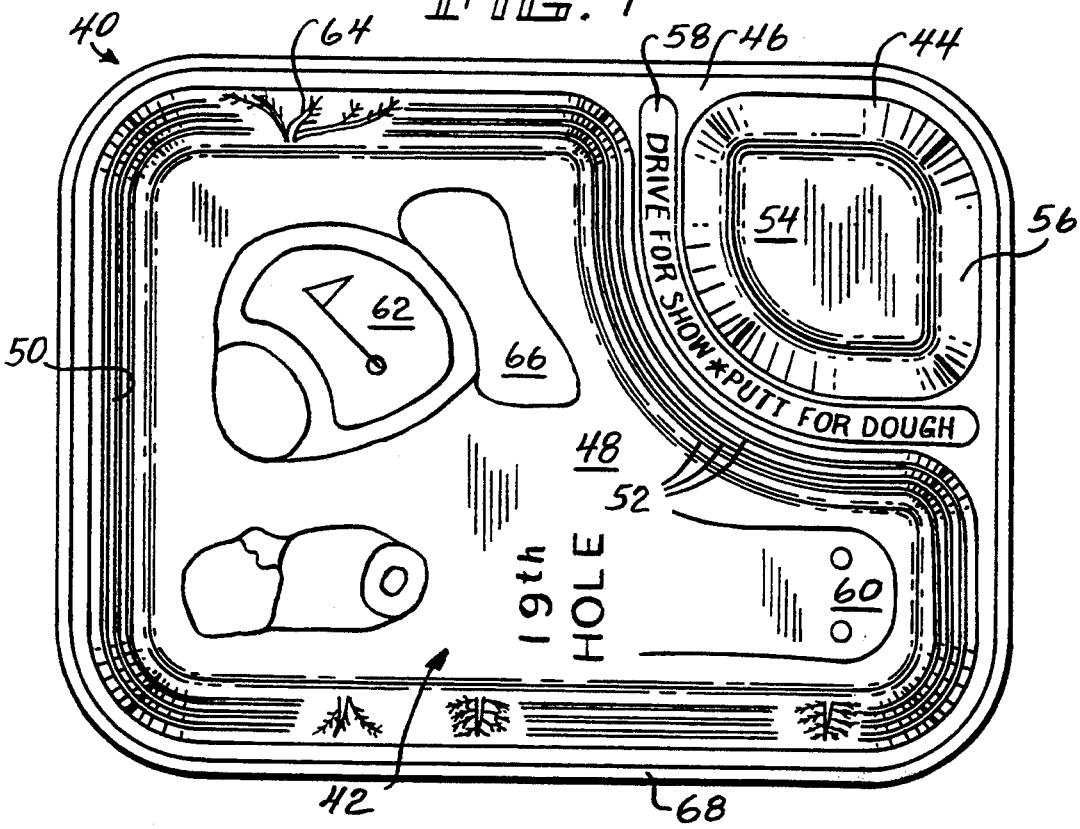
FIG. 7 is a top plan view of the food tray shown in FIG. 5.
Figure 8:
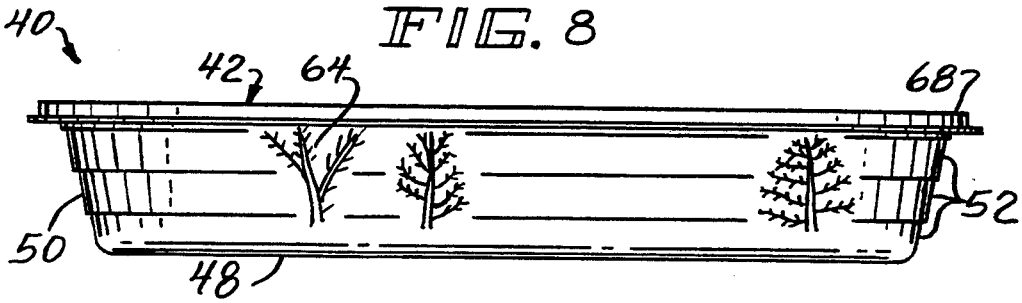
FIG. 8 is a lateral elevation view of the food tray shown in FIG. 7.
Figure 9:
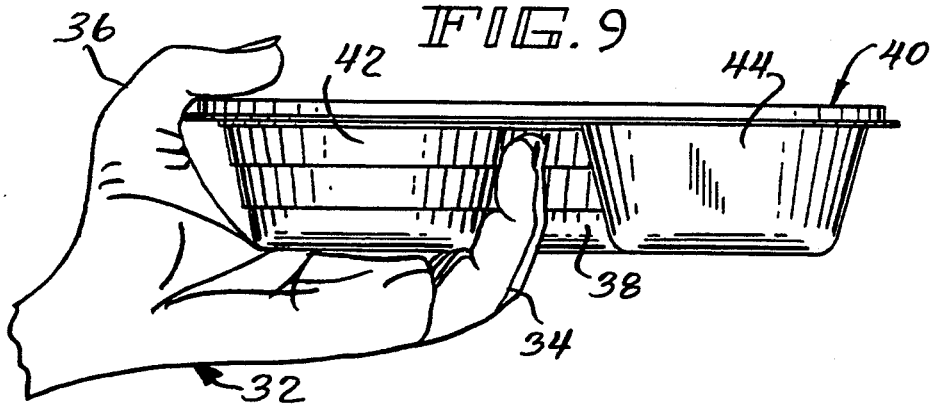
FIG. 9 is an end-on elevation view of the food tray shown in FIG. 7.

Referring to FIG. 5, there is shown an upper perspective view of a dual compartment food tray 40 in accordance with another embodiment of the present invention. FIGS. 7, 8 and 9 respectively show top plan, side elevation and end-on elevation views of the food tray 40 shown in FIG. 5. A sectional view of the food tray 40 shown in FIG. 5 taken along site line 6—6 therein is illustrated in FIG. 6.

Food tray 40 also includes a first recessed compartment 42 and a second recessed compartment 44 arranged in a spaced manner, with an upper panel 46 disposed intermediate and coupling the two compartments. Upper panel 46 is formed integrally with the first and second recessed compartments 42, 44 and may include a recessed portion 58 adapted for receiving, supporting and retaining an eating utensil or condiment (not shown). In addition, a message such as of an athletic or a commercial nature may be provided on upper panel 46 as shown in FIGS. 5 and 7. An upraised peripheal lip, or rim, 68 is disposed about the upper portion of food tray 40 for retaining food in the tray as well as utensils or a condiment container on the tray in place.

The first recessed compartment 42 includes a single, continuous side wall 50 and a lower panel 48 forming the bottom of the recessed compartment. Side wall 50 is comprised of a plurality of tiers 52 to increase the strength of the food tray structure. Side wall 50 is tapered inwardly in proceeding from top to bottom and may include symbols such as trees 64 appropriate for a golf course. Lower panel 48 is provided with various representations of golf course elements such as a tee-off area 60, a putting green 62 and one or more bunkers 66. More specifically, putting green 62 includes a circular line 62*a* and a straight line respectively defining a hole and a pin extending from the hole. A single line 66*a* forms a second closed figure defining a bunker 66. First and second circular lines 60*a* and 60*b* arranged in a spaced manner define the tee-off area 60.

The second recessed compartment 40 is similarly provided with a single, continuous side wall 56 and a generally flat lower panel 54 forming the bottom of the compartment. Lower panels 48 and 54 are in generally mutual alignment in a common plane for stable positioning of the food tray 40 on a flat support surface. A slot 98 on a bottom portion of the food tray 40 is sized to receive a user's fingers for stabilizing and supporting the food tray.

Referring to FIG. 9, there is shown the manner in which food tray 40 is easily supported in the hand 68 of a user. Disposed intermediate respective lower portions of the first and second recessed compartments 42 and 44 is a downward extending slot 38. Slot 38 is adapted to receive the fingers 34 of a user of the food tray 40, while the user's thumb 36 is positioned over an adjacent, upper edge of the food tray as shown in the figure. The palm portion of the user's hand 32 provides support for the food tray 40, while the fingers 34 and thumb 36 respectively disposed beneath and above the food tray provide stability in the grasp of the user's hand as shown in the figure. Slot 38 thus permits the food tray 40 to be stably and securely supported by a single hand of a food tray user. While the figure shows the user's fingers 34 inserted in slot 38 in an upward direction, they may also be inserted in the slot from the side and extend inwardly toward the center of the food tray 40. In either case, the user's fingers engage the food tray 40 intermediate the first and second recessed compartments 42, 44 which provides a balanced, stable arrangement for holding the tray.

Figure 10:
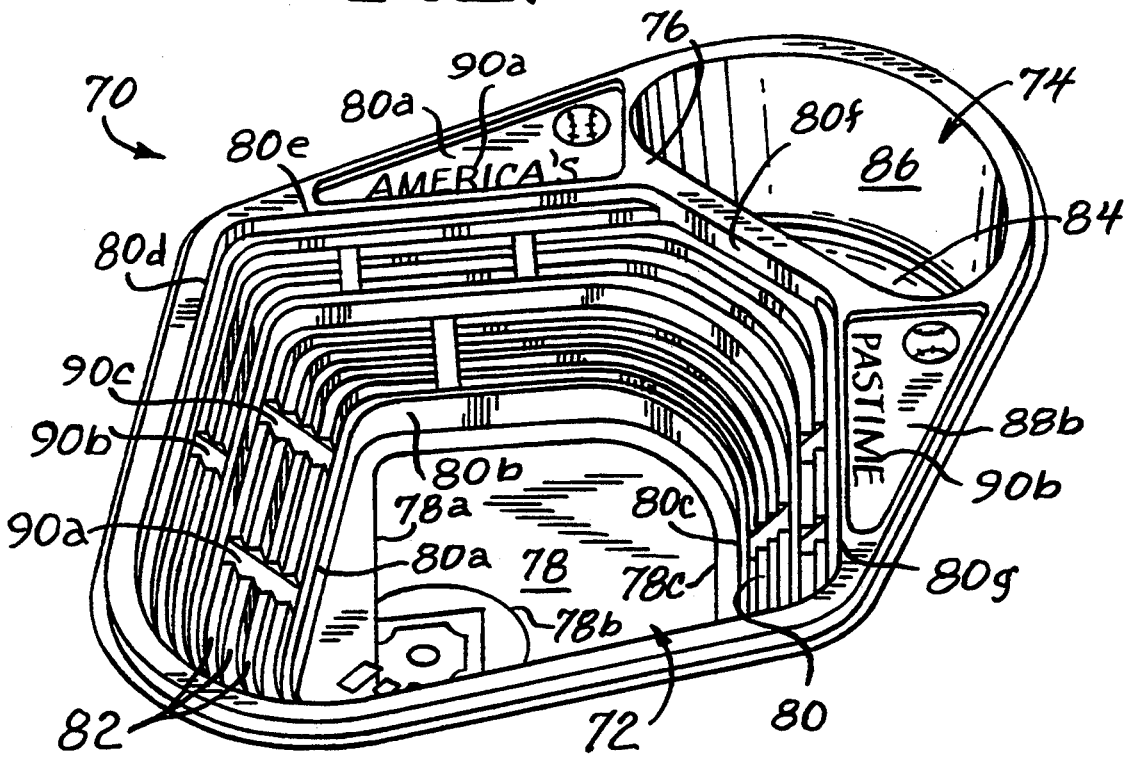
FIG. 10 is an upper perspective view of yet another embodiment of a dual compartment food tray in accordance with the present invention, wherein one of the recessed compartments is in the form of a baseball stadium.

Referring to FIG. 10, there is shown yet another embodiment of a food tray 70 in accordance with the principles of the present invention. Food tray 70 also includes a first recessed compartment 72 and a second recessed compartment 74 separated by an upper panel 76. Upper panel 76 is formed integrally with and disposed intermediate the first and second recessed compartments 72, 74 and includes recessed portions 88*a* and 88*b* adapted for receiving, supporting and retaining an eating utensil or a condiment (not shown). Each of the recessed portions 88*a* and 88*b* may be provided with a well known athletic symbol or an athletic or commercial message 90*a* and 90*b*. The first recessed compartment 72 is in the general form of a baseball stadium and includes a generally flat lower panel 78 forming the bottom of the compartment. Lower panel 78 is in the form of a baseball field. The first recessed compartment 72 further includes a single, continuous side wall 80 comprised of a plurality of adjacent step-like tiers 82 representing the seating area in a baseball stadium disposed about the baseball field depicted on the lower panel 78. Side wall 80 is tapered inwardly in proceeding from top to bottom similar to the shape of the spectator seating area in a baseball stadium. To further simulate a spectator seating area, a plurality of aisles 90*a*, 90*b* and 90*c* are disposed in a spaced manner about the side wall 80 seating area. As in the previous embodiments, tiers 82 of side wall 80 substantially increase the strength of the food tray 70 permitting the use of thin plastic in forming the food tray.

More specifically, lower panel 78 includes first and second straight lines 78*a* (only one of which is shown in FIG. 10) oriented at 90° to one another so as to form first and second foul lines of the baseball field and a first inner curvilinear line 78*b* and a second outer curvilinear line respectively forming outer peripheries of an infield and an outfield. Side wall 80 includes a first plurality of connected inner lower lines, only three of which are shown in FIG. 10 as elements 80*a*, 80*b* and 80*c*, and a second plurality of outer upper lines 80*d*, 80*e*, 80*f* and 80*g* respectively forming inner and outer peripheries of the spectator seating area.

A second recessed compartment 40 includes a side wall 86 and a generally flat lower panel 84. Lower panels 78 and 84 are in a common plane and form first and second generally flat bottom portions of food tray 70 for stability. As previously described with respect to another embodiment of the inventive food tray, the embodiment of food tray 70 shown in FIG. 10 is adapted to receive the fingers of a user's hand in a slot disposed between the first and second recessed compartments 72, 74, while a user's thumb engages an adjacent upper edge portion of the food tray to facilitate manual support of the food tray in one hand of a user.

There has thus been shown a lightweight food tray comprised of a thin plastic which includes a pair of recessed compartments for receiving, supporting and confining food. One of the tray's recessed compartments is in the form of an athletic environment such as a sports stadium or golf course and includes a continuous tiered side wall for increased strength and support permitting the food tray to be formed from a thin layer of plastic. The food tray may be either supported on a flat surface or easily and comfortably held in one hand of user and includes provision for supporting eating accessories such as utensils or condiments and for including an athletic or commercial message or symbols. The food tray is adapted for nested stacking on other similarly configured trays for ease of handling and to facilitate storing.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. A food tray of unitary construction having top and bottom portions, said food tray comprising:

a first recessed compartment for receiving a first portion of food and including a first continuous tiered side wall and a first generally flat lower panel forming a first portion of the bottom of the tray, said flat lower panel including a plurality of lines defining limits and features of a baseball diamond including first and second straight lines oriented at 90° to one another so as to form first and second foul lines of said baseball diamond and a first inner curvilinear line and a second outer curvilinear line respectively forming outer peripheries of an infield and an outfield of said baseball diamond, said side wall including a first plurality of connected inner lower lines and a second plurality of outer upper lines respectively forming inner and outer peripheries of a spectator seating area of a baseball stadium, wherein said first recessed compartment is tapered inwardly in proceeding from top to bottom and wherein said first side wall is continuously tiered between said first plurality of connected inner lower lines and said second plurality of connected outer upper lines so as to form seating rows of said spectator seating area, said first side wall further including a plurality of generally flat, spaced linear sections oriented at 90° to said tiered seating rows so as to form aisles in said spectator seating area;

a second recessed compartment in spaced relation from said first recessed compartment for receiving a second portion of food, said second recessed compartment including a second continuous smooth side wall and a second generally flat lower panel forming a second portion of the bottom of the tray, wherein said first and second lower panels are aligned and in a common plane;

a generally flat upper panel forming a portion of the top of the tray and disposed generally intermediate and formed integrally with said first and second recessed compartments, wherein said upper panel is generally linear and extends intermediate opposed lateral portions of said food tray, said upper panel including an upraised peripheral upper lip and at least one recessed area for supporting and retaining an article such as a condiment or an eating utensil, said at least one recessed area including indicia thereon, wherein said tray is adapted to nest with another similarly configured food tray with said first and second recessed compartments of the tray positioned respectively in the first and second recessed compartments of another such food tray; and a linear slot disposed on a bottom portion of said food tray below said generally flat upper panel, and wherein said slot extends intermediate said opposed lateral portions of said food tray and is sized to receive a user's fingers engaging a lower surface of said generally flat upper panel for supporting and stabilizing said tray and the contents of said first and second compartments.

2. A food tray of unitary construction having top and bottom portions, said food tray comprising:

a first recessed compartment for receiving a first portion of food and including a first continuous tiered side wall, and a first generally flat lower panel forming a first portion of the bottom of the tray, said first lower panel including a plurality of lines defining limits and features of a basketball court including four straight connected lines forming a closed rectangle defining sidelines of said basketball court, a fifth straight line extending across said rectangle so as to divide said rectangle into two equal sections and forming a half court line, and sixth and seventh straight lines disposed in a spaced manner within said rectangle and respectively forming first and second free throw lines, said side wall including a first plurality of connected inner lower lines and a second plurality of outer upper lines respectively forming inner and outer peripheries of a spectator seating area of a basketball arena, wherein said first recessed compartment is tapered inwardly in proceeding from top to bottom and wherein said first side wall is continuously tiered between said first plurality of connected inner lower lines and said second plurality of outer upper lines of said spectator seating area so as to form seating rows of said spectator seating area, said first side wall further including a plurality of generally flat, spaced linear sections oriented at 90° to said tiered seating rows so as to form aisles in said spectator seating area;

a second recessed compartment in spaced relation from said first recessed compartment for receiving a second portion of food, said second recessed compartment including a second continuous smooth side wall and a second generally flat lower panel forming a second portion of the bottom of the tray, wherein said first and second lower panels are aligned and in a common plane;

a generally flat upper panel forming a portion of the top of the tray and disposed generally intermediate and formed integrally with said first and second recessed compartments, wherein said upper panel is generally linear and extends intermediate opposed lateral portions of said food tray, said upper panel including an upraised peripheral upper lip and at least one recessed area for supporting and retaining an article such as a condiment or an eating utensil said at least one recessed area including indicia thereon, wherein said tray is adapted to nest with another similarly configured food tray with said first, and second recessed compartments of the tray positioned respectively in the first and second recessed compartments of another such food tray; and a linear slot disposed on a bottom portion of said food tray below said generally flat upper panel, and wherein said slot extends intermediate said opposed lateral portions of said food tray and is sized to receive a user's fingers engaging a lower surface of said generally flat upper panel for supporting and stabilizing said tray and the contents of said first and second compartments.

3. A food tray of unitary construction having top and bottom portions, said food tray comprising:

a first recessed compartment for receiving a first portion of food and including a first continuous tiered side wall and a first generally flat lower panel forming a first portion of the bottom of the tray, said first flat lower panel including a plurality of lines defining limits and features of a golf course including a first plurality of lines forming a first closed figure defining a putting green including a circular line and a straight line respectively defining a hole and a pin extending from said hole, said first flat lower panel further including a single line forming a second closed figure defining a bunker and first and second circular lines arranged in a spaced manner and forming a tee-off area, wherein said first recessed compartment is tapered inwardly in proceeding from top to bottom and wherein said first side wall is continuously tiered between the top and bottom portions of the tray and includes a plurality of adjacent lines arranged in a spaced manner on said first side wall and forming a plurality of trees about the golf course on said first lower panel;

a second recessed compartment in spaced relation from said first recessed compartment for receiving a second portion of food, said second recessed compartment including a second continuous smooth side wall and a second generally flat lower panel forming a second portion of the bottom of the tray, wherein said first and second lower panels are aligned and in a common plane;

a generally flat upper panel forming a portion of the top of the tray and disposed generally intermediate and formed integrally with said first and second recessed compartments, wherein said upper panel is generally linear and extends intermediate opposed lateral portions of said food tray, said upper panel including an upraised peripheral upper lip and at least one recessed area for supporting and retaining an article such as a condiment or an eating utensil, said at least one recessed area including indicia thereon, wherein said tray is adapted to nest with another similarly configured food tray with said first and second recessed compartments of the tray positioned respectively in the first and second recessed compartments of another such food tray; and a linear slot disposed on a bottom portion of said food tray below said generally flat upper panel, and wherein said slot extends intermediate said opposed lateral portions of said food tray and is sized to receive a user's fingers engaging a lower surface of said generally flat upper panel for supporting and stabilizing said tray and the contents of said first and second compartments.

* * * * *